United States Patent [19]

Frantl

[11] Patent Number: 4,771,582

[45] Date of Patent: Sep. 20, 1988

[54] SUPPORTING FRAMEWORK FOR A SUSPENDED-ROOF

[75] Inventor: Erich Frantl, Vienna, Austria

[73] Assignee: Manfred Beer, Modling, Austria

[21] Appl. No.: 93,948

[22] Filed: Sep. 8, 1987

[30] Foreign Application Priority Data

Sep. 8, 1986 [AT] Austria ..... 2406/86

[51] Int. Cl.[4] ..... E04B 7/14

[52] U.S. Cl. ..... 52/83

[58] Field of Search ..... 52/83

[56] References Cited

U.S. PATENT DOCUMENTS

| | | | |
|---|---|---|---|
| 3,137,097 | 6/1964 | Zeinetz | 52/83 X |
| 3,643,391 | 2/1972 | Mollinger | 52/83 |
| 3,772,836 | 11/1973 | Geiger | 52/83 X |
| 4,581,860 | 4/1986 | Berger | 52/83 X |

*Primary Examiner*—Carl D. Friedman

*Attorney, Agent, or Firm*—Beveridge, DeGrandi & Weilacher

[57] ABSTRACT

To prevent the vibrations caused by wind in suspended-roof supporting frameworks, the suspended-roof supporting framework has main chains composed of bar-shaped main links of relatively small cross section. The ends of these main links are connected to one another at joint centers, and the ends of the main chains are fastened to a stationary perimeter structure. The joint centers of adjacent main chains are connected by means of supplemental links of larger cross section. The supplemental links are larger in cross section than the main links, so they form supplemental chains which are heavier than the main chains. The supplemental chains extend obliquely relative to the main chains, and their ends are fastened to the perimeter structure.

15 Claims, 1 Drawing Sheet

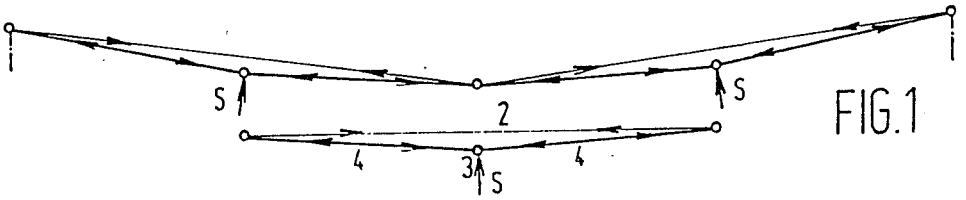
FIG.1
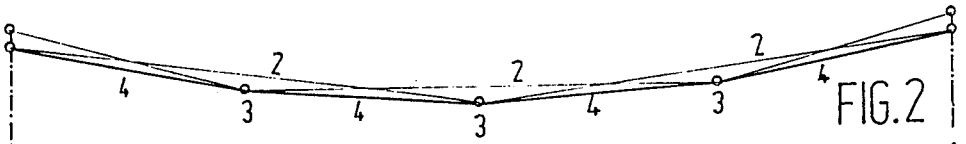
FIG.2
FIG.3
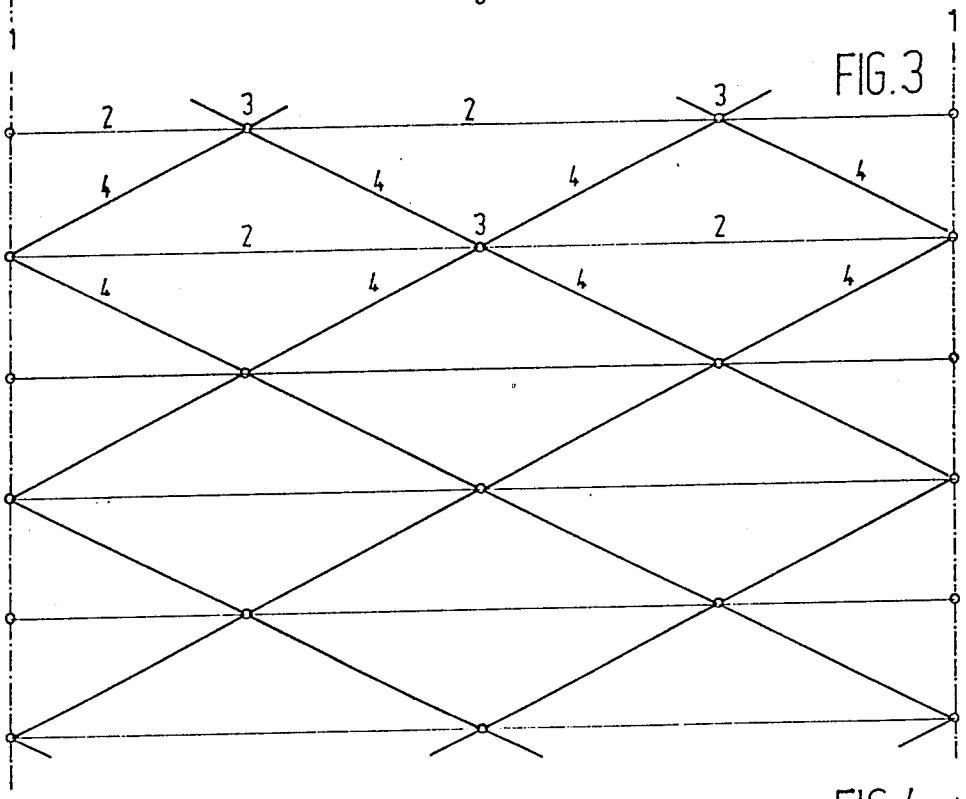
FIG.4
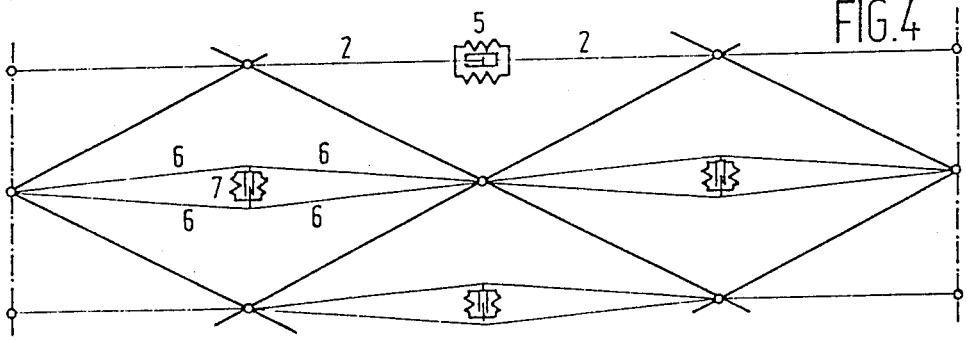

SUPPORTING FRAMEWORK FOR A SUSPENDED-ROOF

BACKGROUND OF THE INVENTION

The invention relates to a suspended-roof supporting framework, in which all the tension members have an actual supporting effect and which, as a result of the spatial arrangement of the supporting members, is rigid enough to prevent the roof surface from being lifted by wind suction and to prevent wind-generated vibration of the roof.

Although suspension-roof structures are the most economical way of bridging large unsupported spans, there have been problems with wind forces since, in terms of both pressure and suction, these wind forces can attain a value which is multiple of the deadweight of these very light roof structures, thus causing the suspended structure both to lift locally due to wind suction and to vibrate.

There have been several possibilities known hitherto for overcoming the problems of vibration and bending. The simplest is to weight the roof surface so much that the wind forces cannot cause such problems. Various other possibilities involve prestressing the suspended structure downwards at short intervals by means of oppositely curved (convex) tensioning ropes, and this has approximately the same effect as applying weight. Both of these solutions are costly and diffcult. various suspended roofs are disclosed in Makowski's book, "Steel Space Structures," which is incorporated herein by reference.

An object of the invention is to provide a suspended-roof supporting framework which is angular, oval or round in horizontal projection and which prevents the above-mentioned disadvantages due to its rigidity, but is nevertheless very light.

SUMMARY OF THE INVENTION

A suspended roof is supported from a framework which has a plurality of girder chains positioned adjacent to each other. Each girder chain is formed of a plurality of main links which are connected to each other at joint centers. The framework also has a plurality of supplemental links which have larger cross sections than the main links and thus are heavier in proportion to their lengths. The supplemental links extend between adjacent chains of main links so that a supplemental link has a first end connected to a joint center on one girder chain and a second end connected to a joint center on an adjacent girder chain.

In one respect, the invention involves such a structure wherein the deadweight of the supplemental links and the main links is carried entirely by the girder chain formed of main links, and any live loads exerted on the joint centers are carried by the main and supplemental links in proportion to their relative cross sections. In another respect, the invention involves such a structure where the main links are under tension so that the deadweight of the framework is carried by the main links of the girder chains.

Preferably, the links are connected together in an articulated manner at the joint centers, and the supplemental links are connected together at the joint centers to form continuous supplemental chains which, in horizontal projection, are oblique to the main girder chains.

To deter oscillations in the framework, spring damper elements may be inserted in the girder chains, or at least one of the girder chains may be formed of two elements which are transversely spread apart by a spring damper device which holds the elements in a diamond-shaped configuration.

BRIEF DESCRIPTION OF THE DRAWINGS

FIG. 1 is an elevational view of portions of a preferred embodiment of the invention along with a force diagram of the forces imposed on that portion.

FIG. 2 is an elevational view of a portion of a preferred embodiment of the invention.

FIG. 3 is a plan view of a preferred embodiment of the invention.

FIG. 4 is a plan view of additional embodiments of the invention.

DETAILED DESCRIPTION OF THE INVENTION

The invention is explained in detail by means of exemplary emhodiments with reference to diagrammatic drawings. For the sake of illustration, these show suspended frameworks with only a few links, but in actual practice such suspended frameworks have a large number of links.

An example of a suspended-roof supporting framework is shown in a plan view in FIG. 3. The supporting framework comprises supporting-framework chains which extend parallel to one another between edges of the structure and which are composed, for example, of bar-shaped main links 2 connected to one another via joint centers 3.

The joint centers 3 of adjacent supporting-framework chains are offset half the length of the links 2 relative to one another.

Supplemental supporting-framework chains extend diagonally and are composed, for example, of bar-shaped links 4 arranged in supplemental chains running parallel to one another. The links 4 are inserted between the joint centers 3 or at the edge of the supporting framework between joint centers 3 and fastening points at the perimeter of the structure.

The links 4 are heavy and have a larger cross section than the links 2 of the lighter main chains.

FIG. 1 shows the strut-frame effect of the chain link 2 of the light supporting-framework chain when suction forces S are exerted at the joint center 3. At the same time, the heavy chain links 4 extending from the particular adjacent joint center 3 receive axial compressive forces.

The thin lines represent the lighter chain links 2, and the thicker lines represent the heavy girder-chain links 4 which run to and fro between the joints 3.

FIG. 2 shows an elevational view of a suspended framework. The edge supports 1 for the roof supporting framework are joints on the centerlines of the stationary perimeter supports or edge girders of the structure.

The individual cross sections and cross-sectional ratios can be determined on the basis of the deadweight and maximum live loads, in such a way that a supporting framework of economical design is obtained. Since the links of the lighter girder chains are always located higher than the points of intersection of the adjacent heavier supplemental chain links 4, the links 4 oppose and resist the lifting of the roof due to wind suction. The diamond-shaped sections formed of the heavier chain links 4 act in the manner of strut frames which surround the lighter main links 3.

When arranged next to one another in a row and offset half a link length, the links 4 fill the entire roof and stiffen it so that no build-up of vibration can occur at any point. The relatively low vibrations possible because of the elasticity of the material of the girders can be reduced further by inserting spring damper elements in the light chain links. So that even very small extensions and deformations can be damped, the light chain links can be divided and held apart from one another in a diamond-shaped manner by means of transverse spring damper elements. Any transmission ratio can be obtained, so that damping starts even at very low amplitudes, thus making it possible to use weaker and less expensive damper elements.

FIG. 4 shows a view similar to that of FIG. 3, with spring damper elements 5 suspended between the light chain links 2. As an alternative to this, the same figure shows light chain links 6 divided up in a diamond-shaped manner with weaker spring damper elements 7 suspended between them. The dampers may be hydraulic or rod dampers provided with return springs, such devices being well known for suppressing oscillations in heavy motor vehicles and valves.

The links 2 may be formed of steel, aluminum or other materials, and their lengths and cross sections will vary in accordance with the span width, incline, external stresses and other roof parameters. Their cross sections may be round, square, angular or flat. For roofs with spans of 20 to 400 meters, the main links may have cross sections from about 2 to 40 square centimeters. The supplemental links 4 must be able to sustain longitudinal compressive forces when the joint centers 3 are lifted by wind suction so, for roof spans of 20 to 400 meters, the links 4 may have lengths of about 1 to 20 meters and cross sections of about 10 to 200 square centimeters.

When an oval or round horizontal projection of the structure is involved, the lightweight girder chains formed of links 2 may extend radially with a an appropriate sag.

Connections at the joints 3 can be made in any way, for example by screwing, riveting, welding, plugging etc. The joints are not necessarily articulated. The supporting network thus obtained is subjected only at the joint centers 3 to loads including wind and snow loads. Thus, the light girder chain forned of the links 2 absorbs, in addition to the already existing tensile stresses resulting from its own weight and the deadweight of the heavier links 4, only a fraction of the live loads imposed on the supporting structure. That fraction of the load is dependent upon and proportional to the ratio of the cross section of the main links 2 to the cross section of the heavier supplemental links 4.

Persons familiar with the field of the invention will appreciate that the invention can be practiced by many arrangements which are different from the preferred embodiments disclosed in this specification. With this in mind, it is emphasized that the invention is not limited only to the disclosed embodiments but is embracing of all structures which fall within the spirit of the following claims.

I claim:

1. A suspended-roof supporting framework, comprising:

a plurality of girder chains positioned adjacent to one another, each of said girder chains being formed of a plurality of main links which are connected together at joint centers, a plurality of supplemental links which have larger cross sections than the main links, said supplemental links extending between adjacent pairs of said girder chains such that each of said supplemental links has a first end connected to one of said joint centers on one of said girder chains and a second end connected to a joint center on an adjacent one of said girder chains, said suspended-roof supporting framework being structured such that the deadweight of said supplemental links and said main links is carried completely by said girder chains while any live loads exerted on said joint centers are carried by the links in proportion to the respective cross sections of said main links and said supplemental links.

2. A suspended-roof supporting framework as claimed in claim 1, wherein said main links are connected to one another in an articulated manner at said joint centers, and said supplemental links are inserted between and connected to said joint centers on said girder chains to form a plurality of continuous supplemental chains which are positioned adjacent one another, extend substantially parallel to one another and intersect said plurality of girder chains.

3. A suspended-roof supporting framework as claimed in claim 1 wherein at least one of said main links is formed of a pair of elements arranged in a diamond shaped manner, and a spring damper device is positioned between said elements and attached at substantially the midpoint of each of said elements to keep said elements spaced apart.

4. A suspended-roof supporting framework as claimed in claim 3, wherein said main links are connected to one another in an articulated manner at said joint centers, and said supplemental links are inserted between and connected to said joint centers on said girder chains to form a pluralty of continuous supplemental chains which are positioned adjacent one another, extend substantially parallel to one another and intersect said plurality of girder chains.

5. A suspended-roof supporting framework as claimed in claim 4 wherein spring damper elements are inserted in said girder chains.

6. A suspended-roof supporting framework as claimed in claim 4 wherein at least one of said main links is formed of a pair of elements arranged in a diamond shaped manner, and a spring damper device is positioned between said elements and attached at substantially the midpoint of each of said elements to keep said elements spaced apart.

7. A suspended-roof supporting framework according to claim 1 wherein the main links are under tension and the supplemental links are substantially untensioned so that the deadweight of the framework is carried by the girder chains.

8. A suspended-roof which is provided with the supporting framework described in claim 1.

9. A suspended-roof supporting framework is claimed in claim 1 wherein the girder chains are substantially parallel and the joint centers of adjacent girder chains are offset about one-half a link length relative to each other in a direction which is parallel to the girder chains.

10. A suspended-roof supporting framework, comprising:

a plurality of girder chains positioned adjacent to one another in a substantially parallel arrangement, each of said girder chains being formed of a plurality of main links which are connected together at joint centers, a plurality of supplemental links which have larger cross sections than the main links, said supplemental links extending between adjacent pairs of said girder chains such that each of said supplemental links has a first end connected to one of said joint centers on one of said girder chains and a second end connected to a joint center on an adjacent one of said girder chains, said main links being under tension and said supplemental links being substantially untensioned so that the deadweight of the framework is carried by the girder chains.

11. A suspended-roof supporting framework as claimed in claim 10, wherein said main links are connected to one another in an articulated manner at said joint centers, and said supplemental links are inserted between and connected to said joint centers on said girder chains to form a plurality of continuous supplemental chains which are positioned adjacent one another, extend substantially parallel to one another and intersect said plurality of girder chains.

12. A suspended-roof supporting framework as claimed in claim 10 wherein at least one of said main links is formed of a pair of elements arranged in a diamond shaped manner, and a spring damper device is positioned between said elements and attached at substantially the midpoint of each of said elements to keep said elements spaced apart.

13. A suspended-roof supporting framework as claimed in claim 10 wherein spring damper elements are inserted in said girder chains.

14. A suspended-roof which is provided with the supporting framework described in claim 10.

15. A suspended-roof supporting framework as claimed in claim 10 wherein the girder chains are substantially parallel and the joint centers of adjacent girder chains are offset about one-half a link length relative to each other in a direction which is parallel to the girder chains.

* * * * *